US009262981B2

(12) United States Patent
Wang

(10) Patent No.: US 9,262,981 B2
(45) Date of Patent: Feb. 16, 2016

(54) DISPLAY DRIVING CIRCUIT, DISPLAY DRIVING METHOD AND DISPLAY APPARATUS

(71) Applicants: BOE TECHNOLOGY GROUP CO., LTD., Beijing (CN); BEIJING BOE DISPLAY TECHNOLOGY CO., LTD., Beijing (CN)

(72) Inventor: Zheng Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 32 days.

(21) Appl. No.: 14/087,263

(22) Filed: Nov. 22, 2013

(65) Prior Publication Data

US 2014/0160184 A1 Jun. 12, 2014

(30) Foreign Application Priority Data

Dec. 12, 2012 (CN) ..... 2012 1 0537327

(51) Int. Cl.
*G09G 3/36* (2006.01)
*G09G 3/00* (2006.01)

(52) U.S. Cl.
CPC ..... *G09G 3/3677* (2013.01); *G09G 3/3666* (2013.01); *G09G 3/003* (2013.01); *G09G 2310/024* (2013.01); *G09G 2310/0205* (2013.01); *G09G 2310/0251* (2013.01); *G09G 2320/0209* (2013.01); *G09G 2320/0252* (2013.01); *G09G 2320/0257* (2013.01)

(58) Field of Classification Search
CPC ..... G09G 2310/0205; G09G 2320/0209; G09G 2320/0252; G09G 3/003; G09G 2310/024; G09G 2310/0251; G09G 2320/0257; G09G 3/3677; G09G 3/3666
USPC ..... 345/103
See application file for complete search history.

(56) References Cited

U.S. PATENT DOCUMENTS

| | | | | |
|---|---|---|---|---|
| 7,471,277 | B2 * | 12/2008 | Sagawa et al. | 345/98 |
| 7,525,527 | B2 * | 4/2009 | Sekine | 345/87 |
| 8,823,606 | B2 * | 9/2014 | Takahara et al. | 345/76 |
| 2003/0179221 | A1 * | 9/2003 | Nitta et al. | 345/690 |
| 2004/0041760 | A1 * | 3/2004 | Tsumura et al. | 345/87 |

(Continued)

OTHER PUBLICATIONS

Extended European Search Report Issued Feb. 17, 2014 Appln. No. EP 13 19 4276.

(Continued)

*Primary Examiner* — Lun-Yi Lao
*Assistant Examiner* — Kelly B Hegarty
(74) *Attorney, Agent, or Firm* — Ladas & Parry LLP

(57) ABSTRACT

Provided is a display driving circuit comprising N gate driving units for being connected to N gate lines on an array substrate respectively, as well as a timing control unit, n pre-charging units and n scanning control units, the N gate driving units, the n pre-charging units and the n scanning control units are all connected to the timing control unit. Further provided is a display driving method, and a display apparatus. According to embodiments of the present disclosure, a time period for liquid crystal molecule being deflected to accurate positions corresponding to desired grayscale will be reduced when a voltage to be charged is supplied on the liquid crystal molecule, thereby accommodating a higher refresh frequency.

15 Claims, 3 Drawing Sheets

(56) References Cited

U.S. PATENT DOCUMENTS

| | | | | |
|---|---|---|---|---|
| 2005/0057580 | A1* | 3/2005 | Yamano et al. | 345/690 |
| 2009/0303166 | A1* | 12/2009 | Tsubata | G09G 3/342 345/87 |
| 2010/0231617 | A1* | 9/2010 | Ueda et al. | 345/690 |
| 2012/0050240 | A1* | 3/2012 | Tanaka et al. | 345/204 |
| 2013/0021315 | A1* | 1/2013 | Kang | 345/212 |
| 2015/0049041 | A1* | 2/2015 | Yousefpor | 345/174 |

OTHER PUBLICATIONS

First Chinese Office Action Appln. No. 201210537327.3; Dated Oct. 13, 2014.

* cited by examiner

DISPLAY DRIVING CIRCUIT, DISPLAY DRIVING METHOD AND DISPLAY APPARATUS

TECHNICAL FIELD OF THE DISCLOSURE

The present disclosure relates to a field of display technology, and particularly to a display driving circuit, a display driving method and a display apparatus.

BACKGROUND

In a conventional liquid crystal panel, gates of thin film transistors (TFTs) are scanned by a gate driver, and pixel electrodes are charged through data lines. Liquid crystal molecules are deflected under an effect of the pixel electrical field so as to generate optical rotations, which is a display principle for a liquid crystal display. In a case that a refresh frequency is higher and higher, a time period of a frame reduces and a charging time for the TFT reduces accordingly, wherein a response time of liquid crystal molecules is on the order of millisecond. Taking a refresh frequency 120 Hz of a full high definition (FHD) resolution 1920×1080 as an example, a time period of each frame is 8.3 ms, and a turning-on time of each row is 8.3/1080=7.68 μs. A scanning backlight technology is usually adopted in a shutter glass 3D display mode, and in order to reduce a crosstalk phenomenon, the backlight is turned on only when the liquid crystal molecules deflect to desired corresponding grayscales. A high refresh frequency will cause that the charging time for the TFT becomes shorter, and the time required for deflecting from one grayscale to another grayscale of the liquid crystal molecules, that is, the response time of the liquid crystal molecules is too long, both of which will cause that the crosstalk phenomenon becomes more severe.

SUMMARY

Technical Problem to be Solved

A technical problem to be solved in the present disclosure is how to shorten the response time of the liquid crystal molecules to accommodate the higher refresh frequency.

Technical Solution

In order to solve the above technical problem, a display driving circuit is provided in embodiments of the present disclosure, the display driving circuit comprises N gate driving units for being connected to N gate lines on an array substrate, respectively, and the display driving circuit further comprises a timing control unit, n pre-charging units and n scanning control units, wherein the N gate driving units, the n pre-charging units and the n scanning control units are all connected to the timing control unit, n represents a number of groups into which the N gate lines on the array substrate are divided in advance and is an integer greater than or equal to 2;

the n pre-charging units are connected to the n gate line groups pre-divided on the array substrate, respectively, the timing control unit is used to control the gate driving units to input scanning signals to the gate lines, respectively; the timing control unit is further used to control an $i^{th}$ pre-charging unit to insert a pre-charging signal into an $i^{th}$ gate line group before the scanning signals are input to the gate lines in the $i^{th}$ gate line group and control an $i^{th}$ scanning control unit to pause the input of scanning signals at the same time, the pre-charging signal is used to turn on thin film transistors connected to the gate lines in the gate line group, such that the timing control unit controls the data lines to pre-charge pixel units connected to the thin film transistors, the $i^{th}$ scanning control unit triggers the gate driving unit corresponding to the $i^{th}$ gate line group to input the scanning signals to the gate lines in the gate line group after the insertion is completed, wherein i=1, 2, . . . , n, $0<n\leq N$.

Preferably, the display driving circuit further comprises: N first switches connected to the timing control unit, and connected to the N gate driving units, respectively, the N first switches are used to connect the N gate driving units to the N gate lines, respectively, and the timing control unit is further used to turn off the first switches when the $i^{th}$ pre-charging unit inserts the pre-charging signal into the $i^{th}$ gate line group and turn on the first switches when the gate driving units input the scanning signals.

Preferably, the first switches are MOS transistors, each of the MOS transistors has a gate connected to the timing control unit, a source and a drain thereof are connected to a corresponding gate driving unit and a corresponding gate line, respectively.

Preferably, the display driving circuit further comprises: n second switches connected to the timing control unit, and connected to the n pre-charging units, respectively, the n second switches are used to connect the n pre-charging units to the n gate line groups respectively, the timing control unit is further used to turn off the second switches when the gate driving units input the scanning signals and turn on the second switches when the pre-charging units input the pre-charging signals.

Preferably, the second switches are MOS transistors each of the MOS transistors has a gate connected to the timing control unit, a source and a drain thereof are connected to a corresponding pre-charging unit and a corresponding gate line, respectively.

Preferably, the display driving circuit further comprises a backlight driving unit connected to the timing control unit, the timing control unit is further used to control the backlight driving unit to drive an $i^{th}$ backlight source to emit light after the scanning of the gate lines in the $i^{th}$ gate line group are completed, and a $((i+1)\bmod n)^{th}$ pre-charging unit is turned on after the $i^{th}$ backlight source emits light.

In the embodiments of the present disclosure, there is also provided a display apparatus comprising any display driving circuit as described above.

In the embodiments of the present disclosure, there is also provided an array substrate comprising N gate lines being divided into n groups, the array substrate further comprises any display driving circuit as described above, the N gate driving units are connected to the N gate lines, respectively, and the n pre-charging units are connected to the n gate line groups, respectively, wherein n is an integer greater than or equal to 2.

Preferably, numbers of gate lines in each of the n gate line groups are same.

In the embodiments of the present disclosure, there is further provided a display apparatus comprising above described array substrate.

In the embodiments of the present disclosure, there is further provided a display driving method comprising steps of:

S1: pre-charging pixel units controlled by gate lines in an $i^{th}$ gate line group and stopping inputting scanning signals to the gate lines at the same time;

S2: scanning the gate lines in the $i^{th}$ gate line group sequentially after the pre-charging to the $i^{th}$ gate line group is completed;

S3: setting i to ((i+1)mode n) after the scanning of the gate lines in the $i^{th}$ gate line group is completed, wherein n is a number of the gate line groups;

performing the steps of S1 to S3 repeatedly to display a picture.

Preferably, in the step S3, after the scanning of the gate lines in the $i^{th}$ gate line group is completed, a backlight source corresponding to the $i^{th}$ gate line group is turned on, and i is set to ((i+1)mod n) after the backlight source is turned on.

Benefit Effect

The display driving circuit according to the embodiments of the present disclosure inserts black levels to pixels in a region according to a region division before charging the pixels, that is, supplies a pre-charging voltage to TFTs in the region according to the region division, the liquid crystal molecule will be deflected at first under such pre-charging voltage, so that the time required for deflecting to an accurate position corresponding to a desired grayscale of the liquid crystal molecule will be reduced when the voltage to be charged is supplied on the liquid crystal molecule, thereby may accommodate a higher refresh frequency.

DETAILED DESCRIPTION

Particular implementations of the present disclosure will be described below in detail in combination with the accompanying drawings and the embodiments of the present disclosure, which are only illustrative and give no limitation to the scope of the present disclosure.

Figure 1:
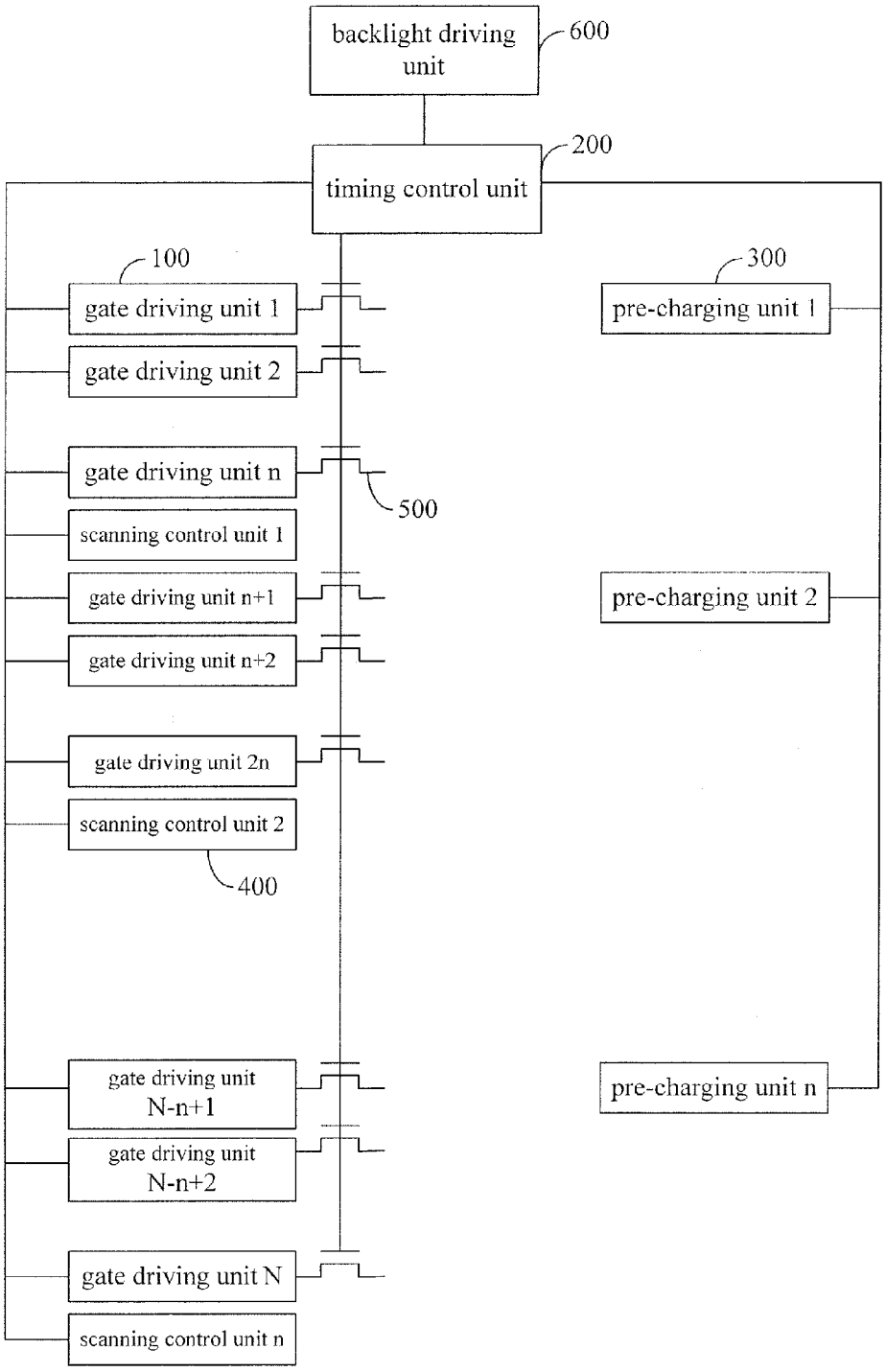
FIG. 1 is a schematic structure diagram of a display driving circuit according to an embodiment of the present disclosure.

As shown in FIG. 1, a display driving circuit according to an embodiment of the present disclosure comprises N gate driving units 100 connected to N gate lines on an array substrate, respectively, and further comprises a timing control unit 200, n pre-charging units 300 and n scanning control units 400. The N gate driving units 100, the n pre-charging units 300 and the n scanning control units 400 are all connected to the timing control unit 200, wherein n represents a number of groups into which the N gate lines on the array substrate are divided in advance and is an integer greater than or equal to 2. That is to say, the N gate lines on the array substrate are divided into n groups, for example, taking a television with 120 Hz and a FDH resolution as an example, both the numbers of the gate driving units 100 and the number of the gate lines are 1080, then the 1080 gate lines are divided into four groups, each of which comprises 270 gate lines.

The n pre-charging units 300 are connected to the n gate line groups divided in advance on the array substrate, respectively, the timing control unit 200 is used to control the gate driving units 100 to input scanning signals to the gate lines; the timing control unit 200 is further used to control an $i^{th}$ pre-charging unit 300 to insert a pre-charging signal to an $i^{th}$ gate line group before the scanning signals are input to the gate lines in the $i^{th}$ gate line group, and control an $i^{th}$ scanning control unit 400 to pause the input of scanning signals at the same time. The pre-charging signal is used to turn on thin film transistors connected to the gate lines in the gate line group on the array substrate, thus the timing control unit controls the data lines to pre-charge pixel units connected to the thin film transistors, such that liquid crystal molecules are deflected at first under an effect of a pre-charging voltage corresponding to the pre-charging signal. The controlling of the timing control unit on the data lines may be implemented by controlling driving units of the data lines.

After the insertion of the pre-charging signal is completed, the $i^{th}$ scanning control unit 400 triggers the gate driving units 100 corresponding to the $i^{th}$ gate line group to input scanning signals to the gate lines in the $i^{th}$ gate line group, respectively, wherein i=1, 2, . . . , n, $0<n\leq N$.

Figure 2:
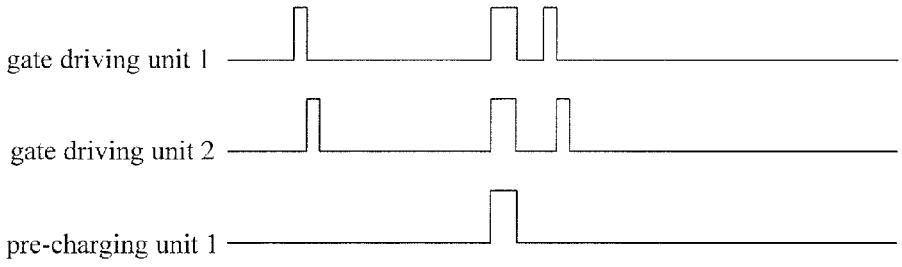
FIG. 2 is a timing chart of signals as driving to display.

The display driving circuit according to the embodiments of the present disclosure inserts black levels to pixels in a region according to a region division before charging the pixels, that is, supplies a pre-charging voltage to TFTs in the region according to the region division, the driving timing is as illustrated in FIG. 2. The liquid crystal molecules will be deflected at first under such pre-charging voltage, and then an actual charging voltage is applied to the liquid crystal molecule in order to make the liquid crystal molecule deflect to an accurate position corresponding to a desired grayscale, so that a response time of the liquid crystal molecule is reduced, thereby may accommodate a higher refresh frequency.

Since the gate driving unit 100 is usually a shift register and is connected to the gate line together with the pre-charging unit 300, the pre-charging process performed by the pre-charging unit 300 will affect an operation of the shift register. Therefore, in an example, the display driving circuit according to the embodiment of the present disclosure further comprises: N first switches 500 connected to the timing control unit 200 and connected to the N gate driving units 100, respectively, the N first switches 500 are used to connect the N gate driving units 100 to the N gate lines respectively. The timing control unit 200 is further used to turn off all of the first switches 500 when the $i^{th}$ pre-charging unit 300 inserts the pre-charging signal into the $i^{th}$ gate line group and turn on all of the first switches 500 when the gate driving units 100 input the scanning signals.

The first switches 500 may be MOS transistors, each of the MOS transistor has a gate connected to the timing control unit 200, and a source and a drain thereof are connected to a corresponding gate driving unit 100 and a corresponding gate line, respectively.

In an example, the pre-charging unit 300 may be a controller with a one-way structure and also may be a shift register. If the pre-charging unit 300 is a shift register, the display driving circuit according to the embodiment of the present disclosure may further comprise: n second switches (not shown) connected to the timing control unit 200 and connected to the n pre-charging units 300, respectively, the n second switches are used to connect the n pre-charging units 300 to the n gate line groups, respectively. That is, the n second switches are connected between the n pre-charging units 300 and the n gate line groups, respectively, and are used to control connections or disconnections between the pre-charging units 300 and the respective gate line groups under the control of the timing control unit 200. The timing control unit 200 is further used to turn off the second switches when the gate driving units 100 input the scanning signals and turn on the second switches when the pre-charging units 300 input the pre-charging signals.

The second switches may be MOS transistors, each of the MOS transistors has a gate connected to the timing control unit 200, a source and a drain thereof are connected to a corresponding pre-charging unit 300 and a corresponding gate line on the array substrate respectively.

For a shutter 3D display, in an example, the display driving circuit according to the embodiment of the present disclosure may further comprise a backlight driving unit 600 connected to the timing control unit 200. The timing control unit is further used to control the backlight driving unit to drive an $i^{th}$ backlight source to emit light after the the scanning of the gate lines in the $i^{th}$ gate line group is completed, a $((i+1)\text{mod } n)^{th}$ pre-charging unit is turned on after the $i^{th}$ backlight source emits light.

Since the backlight source is turned on after the response of the liquid crystal molecules are completed, for a same refresh period, shorter the response time of the liquid crystal molecules is, longer the turn-on period of the backlight source is and higher the luminance of the displayed picture may be. In addition, shorter the response period of the liquid crystal molecules is, smaller the crosstalk phenomenon is correspondingly.

Figure 3:
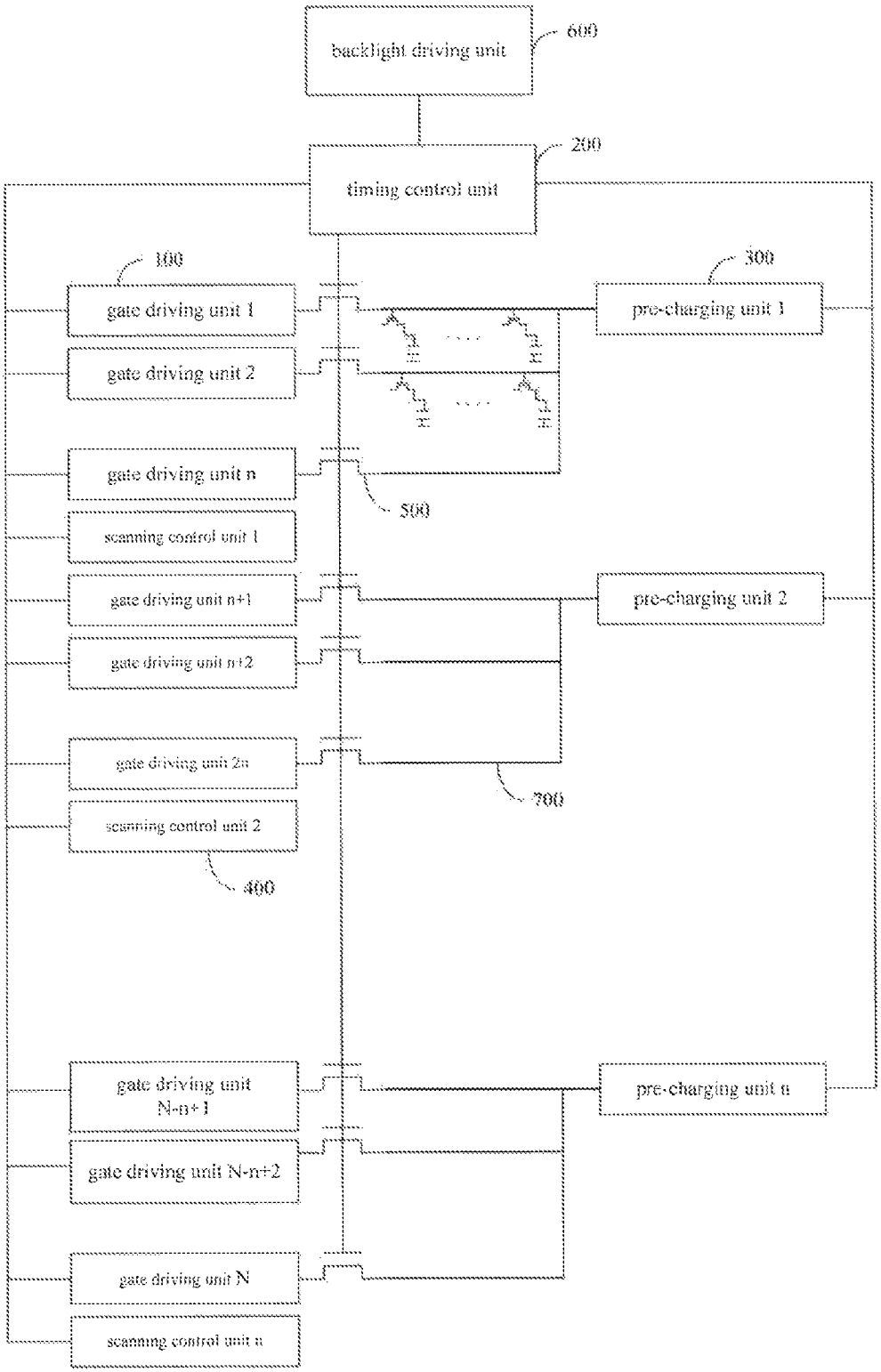
FIG. 3 is a schematic structure diagram of connection between the display driving circuit as shown in FIG. 1 and gate lines on an array substrate.

The display driving circuit according to the present disclosure may be manufactured on the array substrate by a Gate Drive on Array (GOA) technology. As shown in FIG. 3, the array substrate comprises N gate lines 700 being divided into n groups, as well as the above described display driving circuit. The N gate driving units 100 are connected to the N gate lines 700 respectively, and the n pre-charging units 300 are connected to the n gate line groups respectively.

In order to make the luminance of displayed pictures more even, numbers of the gate lines in each of the n gate line groups may be same.

Figure 4:
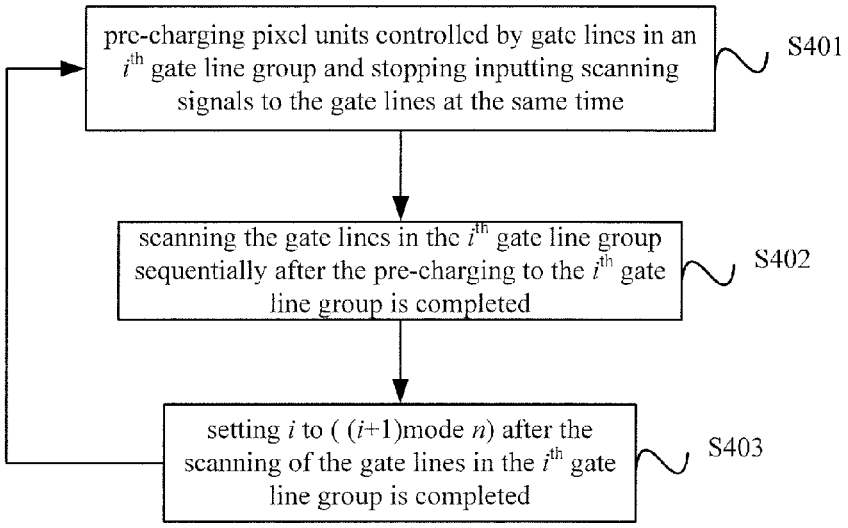
FIG. 4 is a flowchart of a display driving method according to an embodiment of the present disclosure.

A display driving method of the above display driving circuit is shown in FIG. 4 and comprises steps of:

At step S401: pre-charging pixel units controlled by gate lines in an $i^{th}$ gate line group and stopping inputting scanning signals to the gate lines at the same time;

At step S402: scanning the gate lines in the $i^{th}$ gate line group sequentially after the pre-charging to the $i^{th}$ gate line group is completed;

At step S403: setting i to ((i+1)mode n) after the scanning of the gate lines in the $i^{th}$ gate line group is completed. When (i+1)mode n=0, that is, a frame has been completely scanned, the scanning of a next frame may be started.

Steps of S401 to S403 are repeatedly performed to display a picture.

For a shutter 3D display, in the step S403, after the scanning of the gate lines in the $i^{th}$ gate line group is completed, the backlight source corresponding to the $i^{th}$ gate line group is turned on, and i is set to ((i+1)mod n) after the backlight source is turned on.

In the embodiments of the present disclosure, there is further provided a display apparatus comprising the above display driving circuit or the above array substrate. The display apparatus may be a liquid crystal display (LCD) panel, a liquid crystal display television (LCD TV), a liquid crystal display (LCD) monitor, a digital photo frame, a mobile phone, a tablet PC and other product or part having a display function.

The above descriptions are only for illustrating the embodiments of the present disclosure, and in no way limit the scope of the present disclosure. It will be obvious that those skilled in the art may make modifications, variations and equivalences to the above embodiments without departing the spirit and scope of the present disclosure as defined by the following claims. Such variations and modifications are intended to be comprised within the spirit and scope of the present disclosure.

What is claimed is:

1. A display driving circuit comprising N gate driving units for being connected to N gate lines on an array substrate, respectively, wherein the display driving circuit further comprises a timing control unit, n pre-charging units and n scanning control units, the N gate driving units, the n pre-charging units and the n scanning control units are all connected to the timing control unit, n represents a number of groups into which the N gate lines on the array substrate are divided in advance and is an integer greater than or equal to 2;

the n pre-charging units are connected to the n gate line groups pre-divided on the array substrate, respectively, the timing control unit is used to control the gate driving units to input scanning signals to the gate lines, respectively; the timing control unit is further used to control an $i^{th}$ pre-charging unit to insert a pre-charging signal into an $i^{th}$ gate line group before the scanning signals are input to the gate lines in the $i^{th}$ gate line group and control an $i^{th}$ scanning control unit to pause the input of scanning signals at the same time, the pre-charging signal is used to turn on thin film transistors directly connected to the gate lines in the $i^{th}$ gate line group, such that the timing control unit controls data lines to pre-charge pixel units connected to the thin film transistors, the $i^{th}$ scanning control unit triggers the gate driving units corresponding to the $i^{th}$ gate line group to input the scanning signals to the gate lines in the gate line group after the insertion is completed, wherein $i=1, 2, \ldots, n$, $1<n\leq N$.

2. The display driving circuit of claim 1, further comprises N first switches connected to the timing control unit and connected to the N gate driving units, respectively, the N first switches are used to connect the N gate driving units to the N gate lines, respectively, and the timing control unit is further used to turn off the first switches when the $i^{th}$ pre-charging unit inserts the pre-charging signal into the $i^{th}$ gate line group and turn on the first switches when the gate driving units input the scanning signals.

3. The display driving circuit of claim 2, wherein the first switches are MOS transistors, each of the MOS transistor has a gate connected to the timing control unit, a source and a drain thereof are connected to a corresponding gate driving unit and a corresponding gate line, respectively.

4. The display driving circuit of claim 1, further comprises n second switches connected to the timing control unit and connected to the n pre-charging units, respectively, the n second switches are used to connect the n pre-charging units to the n gate line groups, respectively, the timing control unit is further used to turn off the second switches when the gate driving units input the scanning signals and turn on the second switches when the pre-charging units input the pre-charging signals.

5. The display driving circuit of claim 4, wherein the second switches are MOS transistors, each of the MOS transistors has a gate connected to the timing control unit, a source and a drain thereof are connected to a corresponding pre-charging unit and a corresponding gate one, respectively.

6. The display driving circuit of claim 1, further comprises a backlight driving unit connected to the timing control unit, and the timing control unit is further used to control the backlight driving unit to drive an $i^{th}$ backlight source to emit light after the scanning of the gate lines of the $i^{th}$ gate line group is completed, a $((i+1)\text{mod } n)^{th}$ pre-charging unit is turned on after the $i^{th}$ backlight source emits light.

7. A display apparatus comprising a display driving circuit, wherein the display driving circuit comprises N gate driving units for being connected to N gate lines on an array substrate, respectively, wherein the display driving circuit further comprises a timing control unit, n pre-charging units and n scanning control units, the N gate driving units, the n pre-charging units and the n scanning control units are all connected to the timing control unit, n represents a number of groups into which the N gate lines on the array substrate are divided in advance and is an integer greater than or equal to 2;

the n pre-charging units are connected to the n gate line groups pre-divided on the array substrate, respectively, the timing control unit is used to control the gate driving units to input scanning signals to the gate lines, respectively; the timing control unit is further used to control an $i^{th}$ pre-charging unit to insert a pre-charging signal into an $i^{th}$ gate line group before the scanning signals are input to the gate lines in the $i^{th}$ gate line group and control an $i^{th}$ scanning control unit to pause the input of scanning signals at the same time, the pre-charging signal is used to turn on thin film transistors directly connected to the gate lines in the $i^{th}$ gate line group, such that the timing control unit controls data lines to pre-charge pixel units connected to the thin film transistors, the $i^{th}$ scanning control unit triggers the gate driving units corresponding to the $i^{th}$ gate line group to input the scanning signals to the gate lines in the gate line group after the insertion is completed, wherein i=1, 2, . . . , n $1<n\leq N$.

8. The display apparatus of claim 7, further comprises N first switches connected to the timing control unit and connected to the N gate driving units, respectively, the N first switches are used to connect the N gate driving units to the N gate lines, respectively, and the timing control unit is further used to turn off the first switches when the $i^{th}$ pre-charging unit inserts the pre-charging signal into the $i^{th}$ gate line group and turn on the first switches when the gate driving units input the scanning signals.

9. The display apparatus of claim 8, wherein the first switches are MOS transistors, each of the MOS transistor has a gate connected to the timing control unit, a source and a drain thereof are connected to a corresponding gate driving unit and a corresponding gate line, respectively.

10. The display apparatus of claim 7, further comprises n second switches connected to the timing control unit and connected to the n pre-charging units, respectively, the n second switches are used to connect the n pre-charging units to the n gate line groups, respectively, the timing control unit is further used to turn off the second switches when the gate driving units input the scanning signals and turn on the second switches when the pre-charging units input the pre-charging signals.

11. The display apparatus of claim 10, wherein the second switches are MOS transistors, each of the MOS transistors has a gate connected to the timing control unit, a source and a drain thereof are connected to a corresponding pre-charging unit and a corresponding gate line, respectively.

12. The display apparatus of claim 7, further comprises a backlight driving unit connected to the timing control unit, and the timing control unit is further used to control the backlight driving unit to drive an $i^{th}$ backlight source to emit light after the scanning of the gate lines of the $i^{th}$ gate line group is completed, a $((i+1)\text{mod } n)^{th}$ pre-charging unit is turned on after the $i^{th}$ backlight source emits light.

13. The display apparatus of claim 7, wherein numbers of the gate lines in each of the n gate line groups are same.

14. A display driving method for a display driving circuit, comprising steps of:

S1: pre-charging pixel units controlled by gate lines in an $i^{th}$ gate line group and stopping inputting scanning signals to the gate lines at the same time;

S2: scanning the gate lines in the $i^{th}$ gate line group sequentially after the pre-charging to the $i^{th}$ gate line group is completed;

S3: setting i to ((i+1)mode n) after the scanning of the gate lines in the $i^{th}$ gate line group is completed, wherein n is the number of the gate line groups;

performing the steps of S1 to S3 repeatedly to display a picture, wherein the display driving circuit comprises N gate driving units for being connected to N gate lines on an array substrate, respectively, wherein the display driving circuit further comprises a timing control unit, n pre-charging units and n scanning control units, the N gate driving units, the n pre-charging units and the n scanning control units are all connected to the timing control unit, n represents a number of groups into which the N gate lines on the array substrate are divided in advance and is an integer greater than or equal to 2;

the n pre-charging units are connected to the n gate line groups pre-divided on the array substrate, respectively, the timing control unit is used to control the gate driving units to input scanning signals to the gate lines, respectively; the timing control unit is further used to control an $i^{th}$ pre-charging unit to insert a pre-charging signal into an $i^{th}$ gate line group before the scanning signals are input to the gate lines in the $i^{th}$ gate line group and control an $i^{th}$ scanning control unit to pause the input of scanning signals at the same time, the pre-charging signal is used to turn on thin film transistors directly connected to the gate lines in the $i^{th}$ gate line group, such that the timing control unit controls data lines to pre-charge pixel units connected to the thin film transistors, the $i^{th}$ scanning control unit triggers the gate driving units corresponding to the $i^{th}$ gate line group to input the scanning signals to the gate lines in the gate line group after the insertion is completed, wherein i=1, 2, . . . , n, $1<n\leq N$.

15. The display driving method of claim 14, wherein in the step S3, after the completion of the scanning of the gate lines in the $i^{th}$ gate line group, the backlight corresponding to the $i^{th}$ line group is turned on, and i is set to ((i+1)mod n) after the backlight is turned on.

* * * * *